US009943898B2

(12) United States Patent
Kettler et al.

(10) Patent No.: US 9,943,898 B2
(45) Date of Patent: Apr. 17, 2018

(54) HOT-FORMING AND PRESS HARDENING TOOL AND METHOD FOR OPERATING THE HOT-FORMING AND PRESS HARDENING TOOL

(71) Applicant: BENTELER Automobiltechnik GmbH, Paderborn (DE)

(72) Inventors: Markus Kettler, Schlangen (DE); Oliver Dobinsky, Hoevelhof (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 0 days.

(21) Appl. No.: 15/142,883

(22) Filed: Apr. 29, 2016

(65) Prior Publication Data

US 2016/0318087 A1 Nov. 3, 2016

(30) Foreign Application Priority Data

Apr. 30, 2015 (EP) ..... 15166066

(51) Int. Cl.
*B21D 22/02* (2006.01)
*B21D 37/16* (2006.01)
*B21D 22/20* (2006.01)

(52) U.S. Cl.
CPC ..... *B21D 22/022* (2013.01); *B21D 22/208* (2013.01); *B21D 37/16* (2013.01)

(58) Field of Classification Search
CPC ..... B21D 37/16; B21D 22/02; B21D 22/022; B21D 22/06; B21D 22/208
USPC ..... 72/392, 393, 370.08
See application file for complete search history.

(56) References Cited

U.S. PATENT DOCUMENTS 8,047,037 B2 * 11/2011 Vehof ..... B21D 22/02 29/421.1
8,118,954 B2 * 2/2012 Beenken ..... B21D 22/022 148/639
8,261,591 B2 * 9/2012 Hielscher ..... B21D 22/022 72/334

(Continued)

FOREIGN PATENT DOCUMENTS

CN 101189350 5/2008
CN 102198465 9/2011

(Continued)

OTHER PUBLICATIONS

EPO translation of WO 2013013803 A1.*

*Primary Examiner* — R. K. Arundale
*Assistant Examiner* — Pradeep C Battula
(74) *Attorney, Agent, or Firm* — Jacobson Holman, PLLC.

(57) ABSTRACT

The present invention relates to a hot-forming and press hardening tool for producing formed sheet metal parts with at least partially high-strength properties, having a top tool with at least one die segment and a bottom tool with at least one die segment, wherein the top tool and the bottom tool are movable toward each other in a press stroke direction while forming a die cavity, wherein tempering channels are arranged in at least one die segment to feed a cooling medium, wherein the die segment of the top tool and/or the die segment of the bottom tool is split into at least two parts with a spreader device coupled to the top tool and/or the bottom tool and is movable in at least one direction of motion transverse to the press stroke direction.

6 Claims, 6 Drawing Sheets

(56) References Cited

U.S. PATENT DOCUMENTS

| | | | | |
|---|---|---|---|---|
| 8,578,750 | B2 * | 11/2013 | Fang | B21D 37/16 72/294 |
| 8,707,751 | B2 * | 4/2014 | Hielscher | B21D 37/16 72/342.4 |
| 8,839,652 | B2 * | 9/2014 | Kondo | B21D 22/208 72/350 |
| 9,050,641 | B2 * | 6/2015 | Cho | B21D 22/208 |
| 2010/0018277 | A1 | 1/2010 | Hielscher | |
| 2012/0260493 | A1 | 10/2012 | Mori | |
| 2015/0266076 | A1 * | 9/2015 | Ueda | B21D 22/208 72/342.3 |
| 2016/0281185 | A1 * | 9/2016 | Graf | B21D 22/022 |

FOREIGN PATENT DOCUMENTS

| | | | | |
|---|---|---|---|---|
| CN | 103003003 | | 3/2013 | |
| CN | 103707066 | | 4/2014 | |
| CN | 103934360 | | 7/2014 | |
| CN | 104043732 | | 9/2014 | |
| CN | 104438599 | | 3/2015 | |
| DE | 102005042765 | | 3/2007 | |
| DE | 102006040224 | | 3/2008 | |
| DE | 102008047971 | | 5/2010 | |
| DE | 102010027554 | | 1/2012 | |
| DE | 102013011419 | | 4/2014 | |
| DE | 102013103612 | | 10/2014 | |
| EP | 1645345 | | 4/2006 | |
| EP | 2548670 | | 1/2013 | |
| WO | WO 2013013803 | A1 * | 1/2013 | B21D 22/022 |
| WO | WO 2014/166839 | | 10/2014 | |

* cited by examiner

PRIOR ART

HOT-FORMING AND PRESS HARDENING TOOL AND METHOD FOR OPERATING THE HOT-FORMING AND PRESS HARDENING TOOL

The present invention relates to a hot-forming and press hardening tool for producing formed sheet metal parts with at least partially high-strength properties.

BACKGROUND OF THE INVENTION

The present invention also relates to a method for operating the hot-forming and press hardening tool for producing formed sheet metal parts with at least partially high-strength properties, wherein during the closing motion and/or at the bottom dead center of the hot-forming tool moving the at least one die segment transverse to the press stroke direction, so that in the die cavity, a section of the die cavity is oriented at plus/minus 20, preferably plus/minus 10° to the press stroke direction and has a contact surface with a formed sheet metal blank that corresponds to at least 80% of the surface pressure of the essentially horizontally oriented sections of the die cavity.

In order to manufacture assembly components, in particular motor vehicle assembly components, it is known to process sheet metal blanks by means of forming processes, in particular press forming in a tool. Formed sheet metal assembly components are produced in this manner for car body fabrication, structural assembly components, but also exterior sheet metal skin assembly components. In these cases, formed sheet metal assembly components are preferably made from steel materials, but also from light-weight metal materials.

In recent years, in particular hot-forming and press hardening technologies have been established, based on which temperable steel alloys can be processed. Based on a preheating step, in particular above AC3 temperature, the forming degrees of freedom of a sheet metal blank can increased, allowing highly complex, three-dimensionally shaped assembly components to be produced. The assembly component then remains in the tool and is hardened in a rapid cooling step that involves at least partial martensite formation, so that an assembly component is produced with at least partial high-strength, in particular maximum strength material properties. This results in the production of assembly components that are lighter, while also being harder compared to assembly components that were made in a cold forming step from a conventional steel alloy.

For this purpose, however, it is in particular necessary when using a press forming tool that the die cavity created at the bottom is dead center—and thus when the press forming tool has been fully closed—has a sufficiently large surface contact to the formed sheet metal blank in order to facilitate a good thermal transfer from the still hot, formed sheet metal blank to the forming tool during the cooling process to be performed for quench hardening purposes. The heat is then, for instance, removed by a cooling medium that flows through cooling channels of the forming tool.

This is reflected in the manufacturing and design of a hot-forming and press hardening tool, so that a largest possible surface contact is ensured. However, when operated, the hot-forming and press hardening tool exhibits thermal expansion and shrinkage of the tools themselves. In addition, the blanks made available for processing exhibit production variations, so that only a few tenth of a millimeter can in this case have the effect that, for instance, no longer sufficient surface contact is achieved. Moreover, the forming surfaces are subject to mechanical wear during operation to produce several thousand parts, said wear also having the potential of creating a non-surface contact.

In this regard, a forming tool is, for example, known from DE 10 2013 011 419 A1, wherein a forming tool is split into two parts and is actuated by a second press force applied transverse to the press direction by means of an actuating medium. However, a disadvantage is the significantly more elaborate construction and increased effort to operate such a hot-forming and press hardening tool.

BRIEF SUMMARY OF THE INVENTION

The task of the present invention is therefore to provide a hot-forming and press hardening tool that is easy to manufacture, while also being cost-effective and mechanically easy to operate, but also ensures, in particular, for press hardening that the largest possible surface contact is provided, specifically in the area of vertically oriented contact surfaces.

The present invention relates to a hot-forming press and hardening tool for producing formed sheet metal parts with at least partially high-strength properties.

The present invention also relates to a method for operating the hot-forming and press hardening tool for producing formed sheet metal parts with at least partially high-strength properties, wherein during the closing motion and/or at the bottom dead center of the hot-forming tool moving the at least one die segment transverse to the press stroke direction, so that in the die cavity, a section of the die cavity is oriented at plus/minus 20, preferably plus/minus 10° to the press stroke direction and has a contact surface with a formed sheet metal blank that corresponds to at least 80% of the surface pressure of the essentially horizontally oriented sections of the die cavity.

Advantageous embodiments of the present invention are described in the dependent claims.

The hot-forming and press hardening tool for producing formed sheet metal parts made from a steel alloy is suited to achieve at least partially high-strength properties on the formed sheet metal assembly component, and preferably to form and subsequently harden the entire sheet metal part. For this purpose, it has a top tool with at least one die segment and a bottom tool with at least one die segment, wherein the top tool and the bottom tool are movable toward each other in a press stroke direction while forming a die cavity. The die cavity between the die segments of the top tool and bottom tool is then formed when the bottom dead center of the hot-forming and press hardening tool is reached. According to the invention, the hot forming and press hardening tool is characterized in that the die segment of the top tool and/or the die segment of the bottom tool is split into two parts and is movable transverse to the press stroke direction in at least one direction of movement with a spreader device coupled to the upper tool and/or the bottom tool.

According to the invention, in particular the spreader device itself exclusively acts on the die segment, in particular with a spreader wedge, hereinafter also called spreader ram. This results in a straight-forward, rugged, and at the same time effective design that keeps the operating costs of the hot-forming and press hardening tool according to the invention low.

As a result, it is possible with the hot-forming and press hardening tool to also achieve a shift of a die segment in transverse direction to the press stroke direction during the closing motion and/or when the bottom dead center of the hot-forming and press hardening tool is reached, therefore achieving sufficient contact surface pressure between the interior die-forming surface and the exterior surface of the die segments of the formed sheet metal-blank, specifically also on vertically oriented contact surfaces. A high cooling rate can then be achieved in a process-capable manner by feeding through a cooling medium and executing the press hardening, therefore minimizing product rejects when shortening the cycle time for press hardening. The tool according to the invention is in particular suited for producing hot-formed and press-hardened assembly components that have a forming angle from 90° to 110°, preferably 90° to 100°, and particularly preferable from 90° to 95°.

Preferably, the spreader device itself is arranged as a spreader ram, wherein the spreader ram is either arranged on the top tool or on the bottom tool in a fixed location. A second spreader ram can also be arranged respectively on the top tool and the bottom tool. These are then securely and rigidly coupled in a fixed orientation—and therefore in the press stroke direction and transverse to the press stroke direction—with the top tool or the bottom tool. Alternatively, it is advantageously possible to locate the spreader ram movable relative to the top tool and/or the bottom tool. A kinematic coupling can be actuated by the press stroke device using an actuator, for example an additional hydraulic actuator, or the spreader ram can be yet again actuated relative to the top tool and/or the bottom tool with a miscellaneous actuator, for example an electro-mechanical actuator. In particular, it is possible in this case, for instance after reaching the bottom dead center while travelling in press stroke direction, to yet again minimally actuate the spreader ram to generate an increased contact pressure transverse to the press stroke direction.

Furthermore, the at least two die segments on the top tool and/or the at least two die segments on the bottom tool can be movably located on the bottom tool relative to press stroke direction. It is also possible to rigidly locate the at least two die segments to the top tool or the bottom tool in press stroke direction. However, it is important that the at least two die segments are located shiftably, relative to an actuation direction transverse to the press stroke direction, wherein the die segments form a spreader cavity on their side facing away from the created die cavity and the spreader ram enters into the spreader cavity, so that the die segments move toward the outside from the spreader ram in an actuation direction transverse to the press stroke direction. As a result, closing in the press stroke direction ensures a surface contact and/or a surface pressure on the formed sheet metal blank in the sections extending in predominantly horizontal direction, and a relative motion of the die segments in transverse stroke direction also ensures a sufficient surface contact pressure in the sections predominantly extending in vertical direction.

The die segments of the bottom tool and/or the die segments of the top tool are preferably located on the top tool and/or the bottom tool by means of retracting devices. The die segments are then retracted to an original position when the hot-forming and press hardening tool is opened. The retracting devices couple each of the die segments of the top tool to each other, or couple the two die segments of the bottom tool to each other. The retracting devices can also be oriented in press stroke direction, which is necessary for die segments actuatable relative to the press stroke direction. However, the retracting devices are preferably located in particular acting in the horizontal direction, so that the two die segments spread apart in the horizontal direction and therefore transverse to the press stroke direction and are pulled back together by a retracting device, for example in the form of a return spring, and in this case specifically by a tension spring when the spreader ram is withdrawn.

The die segments are preferably equipped with tempering channels to feed through a cooling medium, wherein the tempering channels are coupled with the top tool and/or the bottom tool via elastic and/or sliding connections. In particular, these are elastic hose connections that are for instance compressed or stretched or bent to execute the relative motion, in particular transverse to the press stroke direction. Within the scope of the invention, these can however also be sliding connections, for example in the form of a sliding seat, or for example a sliding sleeve, so that the sliding sleeve compensates the relative length change when the relative motion is performed in axial direction transverse to the press stroke direction, while also providing the option to feed a cooling medium in a fluid-tight manner to the tempering channels in the relevant die segment. In addition to the die segment being cooled with a cooling medium, it is furthermore possible to arrange insulation, and a heated die segment in contact with the insulation, in order to produce assembly components with specifically targeted, locally unhardened zones.

The hot-forming and press hardening tool is furthermore characterized in that the die segments of the top tool are arranged as a two-piece mold, which are coupled with each other transverse to the press stroke direction by a retracting device and in that the die segment of the bottom tool is arranged as a ram that travels into the mold, wherein wedge pushers are arranged on the sides of the ram, and the wedge pushers are actuatable by the mold toward the outside transverse to the press stroke direction when the press stroke is performed.

Furthermore, dead-stops and/or spacer devices are arranged on the top tool and/or the bottom tool. These in particular limit the relative motion transverse to the press stroke direction. In particular, a relative motion transverse to the press stroke direction up to 1 mm, in particular up to 0.5 mm is facilitated.

Dead stops are preferably arranged in a manner that during possible relative motion in the press stroke direction, the die segment also rigidly contacts the dead stops in the press stroke direction when the bottom dead center has been reached, so that the complete forming process is completed no later than at the bottom dead center in press stroke direction.

The present invention furthermore relates to a method for operating the aforementioned hot-forming and press hardening tool, wherein the method is characterized in that during the motion and/or at the bottom dead center, at least one die segment of the top tool or the bottom tool is moved transverse to the press stroke direction, so that a section extending in the die cavity and oriented respectively +/−20°, preferably between +/−10° and particularly preferred +/−5° to the press stroke direction. Therefore, an essentially vertically oriented section of the die cavity has a surface contact with a formed sheet metal blank, said surface contact having at least 80%, preferably 90%, in particular 95%, of the surface pressure compared to a section of the formed sheet metal blank arranged in the die cavity, which essentially extends horizontally and therefore transverse to the press stroke direction. This ensures that a surface contact with essentially uniform surface pressure is present preferably on the entire assembly component, thus allowing the press hardening operation to be performed with high precision.

The hot-forming and press hardening tool according to the invention can be preferably used to produce motor vehicle pillars, transmission tunnels, bumpers, motor vehicle rocker panels, or reinforcement assembly components for motor vehicles. The hot-forming and press hardening tool is in particular suited for assembly components with an elongated section with a U-shaped cross section design, so that the base of the U-shape experiences a surface contact with the die segment due to a surface pressure in press stroke direction, and the legs extending from the base to create the U-shape experience sufficient surface contact with the die segments due to the direction of motion transverse to the press stroke direction. In particular, this achieves a hardness tensile strength of base and legs to an equivalent level at particularly short cycle times for the press hardening operation. The cycle times for loading, forming, holding, and unloading amounting to less than 20 seconds, preferably less than 10 seconds.

BRIEF DESCRIPTION OF THE SEVERAL VIEWS OF THE DRAWINGS

Other advantages, features, characteristics, and aspects of the present invention are discussed in the following description. Preferred embodiments are shown in the schematic figures. These are intended for a better understanding of the invention. The figures show as follows.

The figures use the same references for equivalent or similar assembly components, even when a repeated description is omitted for simplification.

DETAILED DESCRIPTION OF THE INVENTION

Figure 1B:
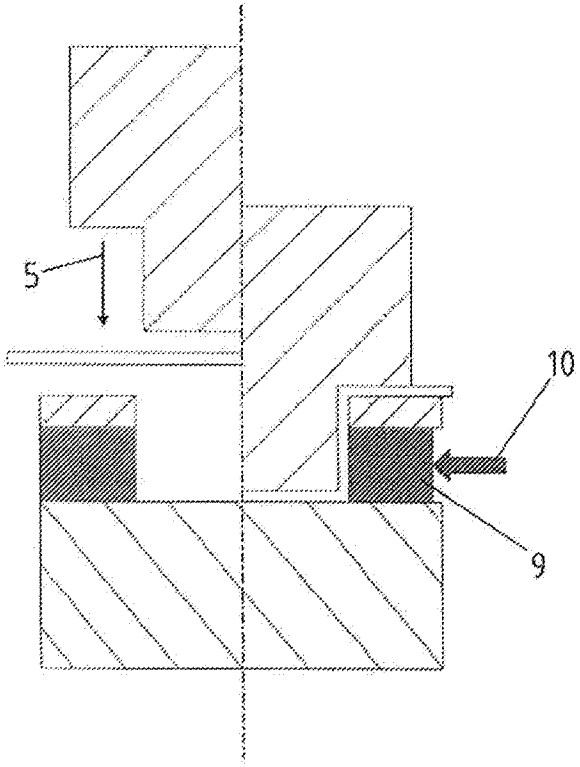
FIGS. 1*a* and *b* the problem locations and a proposed solution from the prior art, FIG. 2 a first embodiment according to the invention with a spreader ram on the top tool, FIG. 3 a second embodiment with relatively movable spreader ram on the top tool, FIG. 4 a third embodiment according to the invention with a split mold on the top tool and a ram on the bottom tool traveling into the split mold, FIG. 5 a cross-section through a motor vehicle pillar with W-shaped profile produced with the hot-forming and press hardening tool according to the invention, and FIG. 6 a cross-section through a motor vehicle [pillar] with W-shaped profile produced with the hot-forming and press hardening tool according to the invention.
Figure 1A:
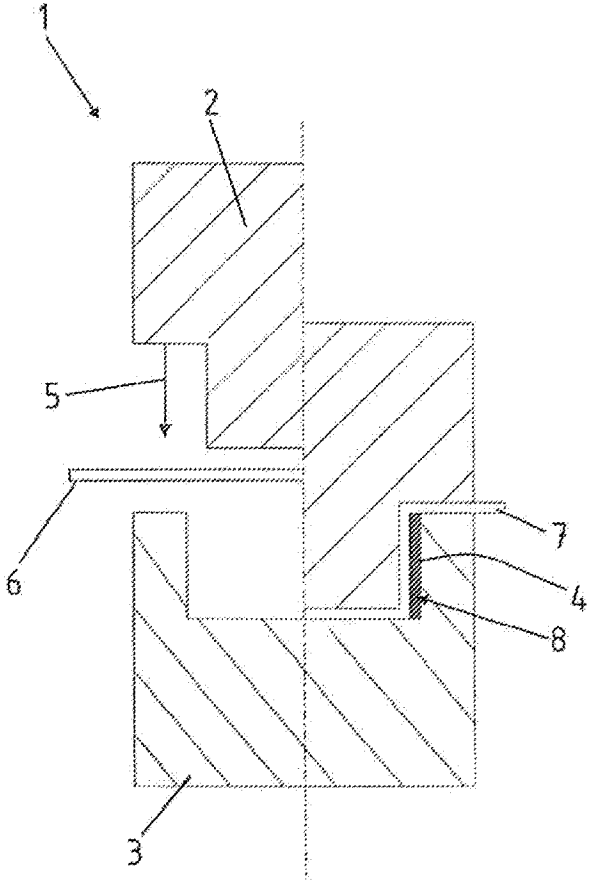
PRIOR ART Fig. 1a

FIG. 1*a* shows a forming tool 1 known from the prior art, having a top tool 2 and a bottom tool 3 that travel into each other in press stroke direction 5 while forming a cavity 4. For this purpose, a sheet metal blank 6 is loaded into the opened forming tool, the sheet metal blank 6 to be formed into the formed sheet metal part 7. The sections of the assembly component remaining after the forming process has been completed, and oriented in press stroke direction 5 and therefore vertically, can in this case have a low surface contact or a low surface pressure, even up to an air gap 8, which is why in this case a low cooling rate and/or low forming accuracy is achieved when a press hardening operation is performed. Until now, a solution in accordance with FIG. 1*b* is known from the prior art, wherein a movable auxiliary segment 9 ensures a surface contact by applying an external second pressing force 10 transverse to the press stroke direction 5.

Figure 2:
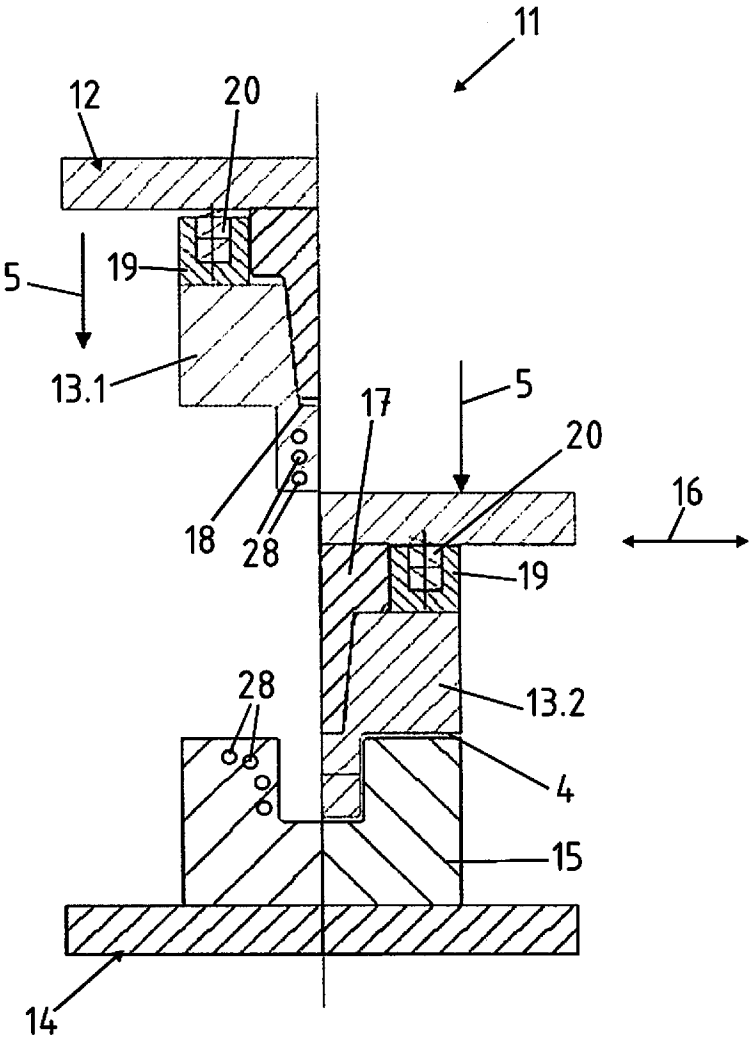

For this purpose, the solution according to the invention provides a hot-forming and press hardening tool 11 according to FIG. 2, wherein two die segments 13.1, 13.2 are located movably on a top tool 12 relative to the top tool 12, and a die segment 15 is located rigidly on a bottom tool 14. When the forming operation is performed in press stroke direction 5, the top tool 12 is then lowered onto the bottom tool 14, and the die segments 13.1, 13.2, 15 are moved toward each other in press stroke direction 5 in a manner that these create a die cavity 4 when the bottom dead center (right image plane of FIG. 2) is reached. In this case, both die segments 13.1, 13.2 of the top tool 12 are located movably relative to the press stroke direction 5, but are also additionally located in a direction of motion 16 transverse to press stroke direction 5. For this purpose, a spreader ram 17 secured on the top tool 12 travels into the spreader cavity 18 on the back of the die segments 13.1, 13.2 of the top tool 12, and, based on a conical or slanted design due to mechanical surface contact and the resulting spreading or shifting, ensures a spreading apart of the die segments 13.1, 13.2 of top tool 12 in the direction of motion 16 transverse to the press stroke direction 5. In order to transfer the full pressing force 10 in press stroke direction 5, dead stop elements 19 are integrated between the top tool 12 and die segments 13.1, 13.2, which result in a shape-conforming surface contact at the bottom dead center. Retracting devices 20 are arranged to guide the die segments 13.1, 13.2 back to the original state.

As shown, the retracting devices 20 execute a motion relative to the press force direction 5, and not shown, retraction devices 20 pull the die segments 13.1, 13.2 toward each other as soon as the spreader ram 17 is withdrawn from these.

Figure 3:
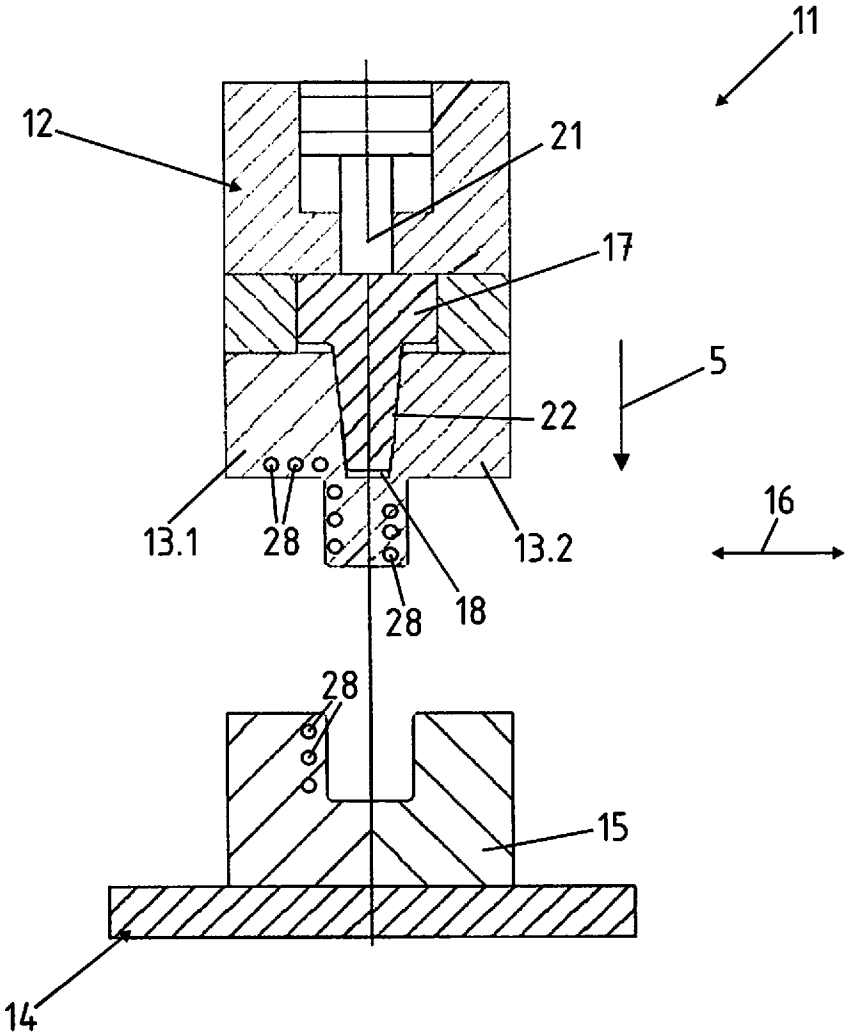

A second embodiment is shown in FIG. 3, wherein here as well, two die segments 13.1, 13.2 are located movably relative to a direction of motion 16 transverse to the press stroke direction 5. The die segments 13.1, 13.2 are however secured rigidly on the top tool 12 in press stroke direction 5. In this case, the spreader ram 17 can perform a motion relative to the top tool 12 und in particular in press stroke direction 5, so that at any point in time during the closing motion or when the bottom dead center is reached, the spreader ram 17 is movable relative to the top tool 12 by an actuator 21, for example a hydraulic ram. The spreader ram 17 causes the movement of the die segments 13.1, 13.2 along its slanted contact surfaces 22 with the spreader cavity 18 of the die segments 13.1, 13.2 in the direction of motion 16 transverse to the press stroke direction 5, so that a sufficient surface contact and/or sufficient surface pressure is achieved in the vertically oriented sections between the die segment and the formed sheet metal blank 6.

Figure 4:
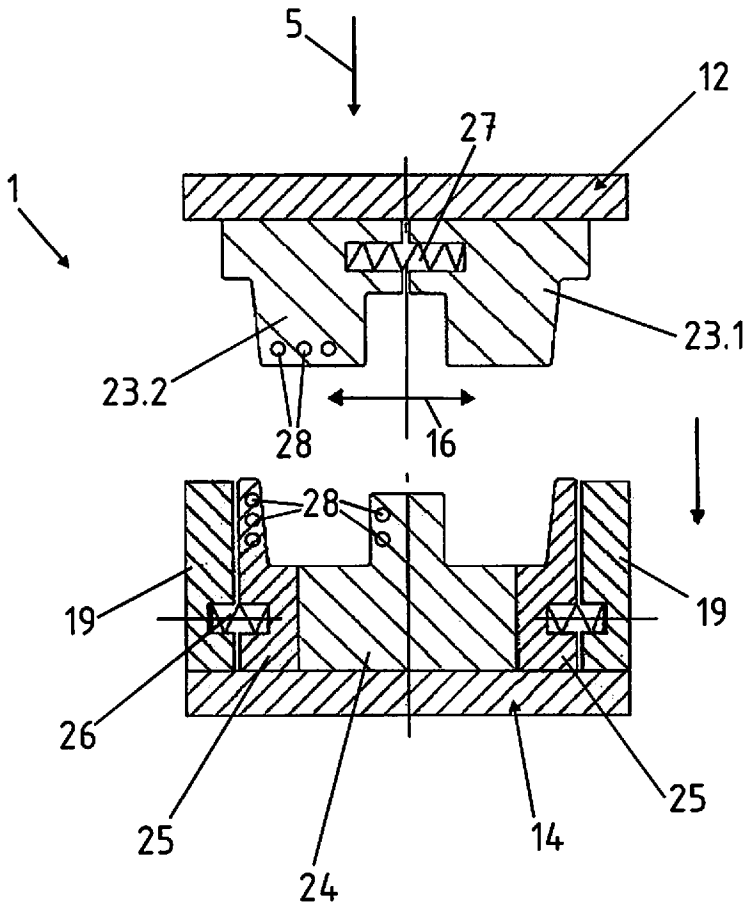

FIG. 4 shows an alternative embodiment of the present invention. In this case, a two-piece mold 23.1, 23.2 is arranged on the top tool 12, which enters into a ram 24 connected rigidly with the bottom tool 14.

Wedge pushers 25 are arranged on the sides of ram 24, which are moved toward the outside in the direction of motion 16 transverse to the press stroke direction 5 as the mold 23.1, 23.2 enters. The wedge pushers 25 are limited on the outside by dead stop elements 19, and are controllable with these using a force device 26, in particular a compression spring and/or a hydraulic system, in a manner that on the one hand generates a return force and on the other achieves a sufficient surface pressure on the external contact surfaces even when the dead stop element 19 is not reached in a shape-conforming manner. The mold elements 23.1, 23.2 can also be moved toward each other relatively in the direction of motion 16. They are pressed against each by a spreader spring 27.

Tempering channels 28 to conduct a tempering medium, in particular a cooling medium, are indicated in FIGS. 2 to 4 in ram 24, mold 23.1, 23.2, resp. die segments 13.1, 13.2. 15. The tempering channels can be distributed uniformly, but can also only be arranged partially, so that a targeted tempering operation can be performed on the formed assembly component.

Figure 5:
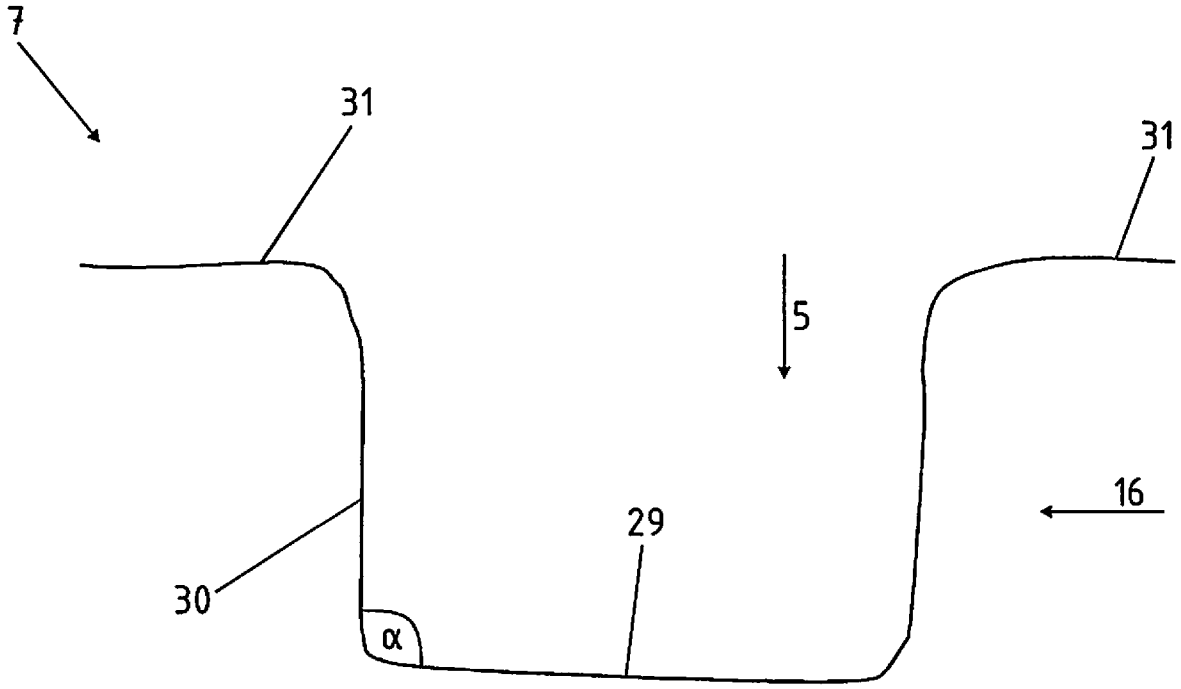

FIG. 5 shows a cross-section of a motor vehicle pillar produced according to the invention, having a base 29 and legs 30 extending from the base 29, and flange 31 that in turn protrudes from legs 30. An angle α of preferably 90° to 100°, in particular 90° to 95°, and particularly preferred of approx. 90° is formed between the base 29 and legs 30. Due to the strength of base 29 and/or the flanges 31 in press stroke direction 5 and because they are produced in the press stroke direction, the former can preferably exhibit a full-surface contact and therefore achieve an optimal heat transfer when the press hardening operation is performed. In this case, the legs 30 are preferably produced in a surface contact with a direction of motion 16 transverse to the press stroke direction 5. According to the invention, it is possible due to the press hardening with the hot-forming and press hardening tool 11 according to the invention, that the tensile strength of legs 30 is at least 90% of the tensile strength of the base 29, preferably more than 95% of the tensile strength. In particular, the tensile strength of the legs 30 is greater than or equal to 98% of the tensile strength of the base 29.

Figure 6:
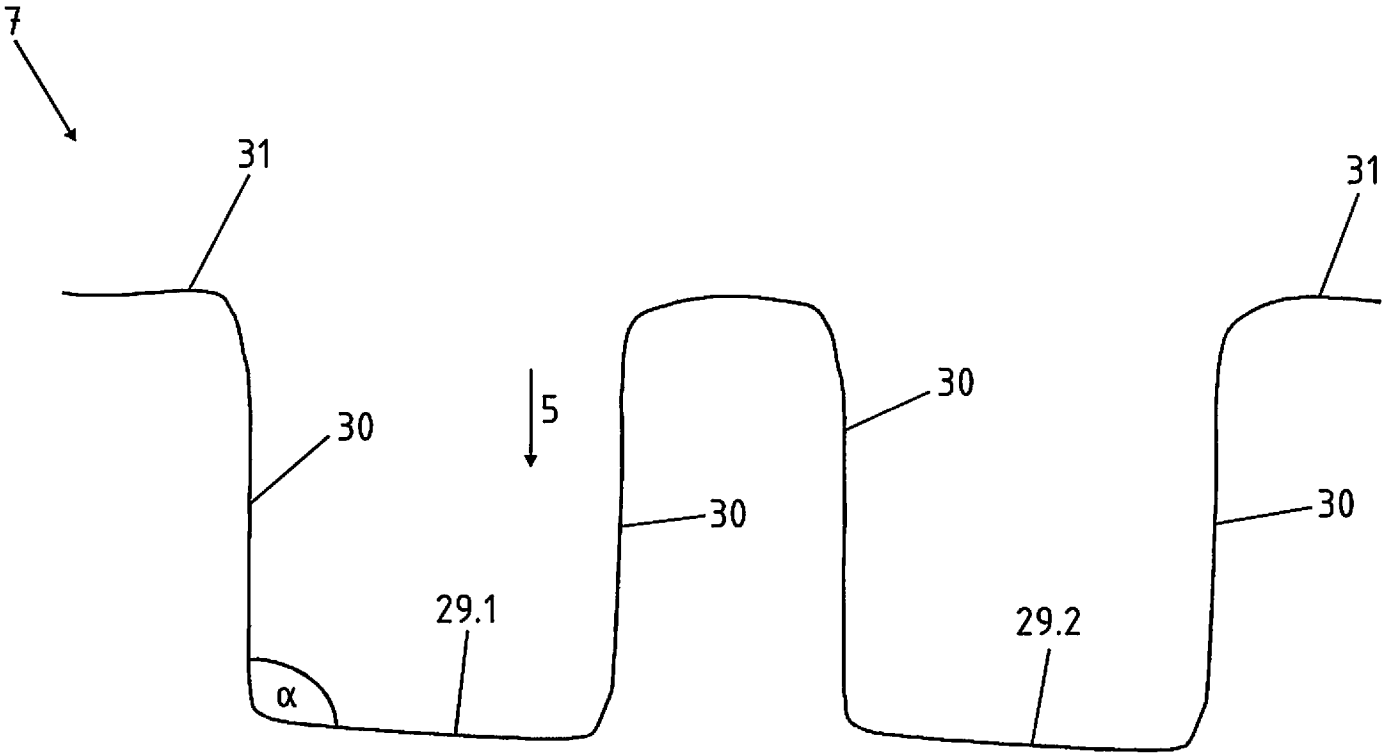

FIG. 6 shows a second embodiment of a formed sheet metal assembly component 7 produced according to the invention, which is produced with the hot-forming and press hardening tool 11 according to the invention. The former has a W-shaped cross-section, which is why the base 29 is arranged in two parts, and consequently resulting in four legs 30. In particular, the formed sheet metal assembly component 7 in accordance with FIG. 6 is produced on a forming tool 1 in accordance with FIG. 4, wherein here as well, the aforementioned relationships of the tensile strengths of base 29 to legs 30 are formed with the adjusted pressing hardnesses.

REFERENCE LABELS

1—Forming tool
2—Top tool
3—Bottom tool
4—Die cavity
5—Press stroke direction
6—Sheet metal blank
7—Formed sheet metal part
8—Air gap
9—Auxiliary segment
10—Press force transverse to 5
11—Hot-forming and press hardening tool
12—Top tool
13.1 Die segment for 12
13.2 Die segment for 12
14—Bottom tool
15—Die segment for 14
16—Direction of motion transverse to 5
17—Spreader ram
18—Spreader cavity
19—Dead stop element
20—Retracting device
21—Actuator
22—Contact surface
23.1—1st part of the mold
23.2—2nd part of the mold
24—Ram
25—Wedge pusher
26—Force device
27—Spreader spring
28—Tempering channels
29—Base
29.1 Partial base
29.2 Partial base
30—Leg
31—Flange
α—Angle

The invention claimed is:

1. Hot-forming and press hardening tool for producing formed sheet metal parts with at least partially high-strength properties, having a top tool with at least one die segment and a bottom tool with at least one die segment, wherein the top tool and the bottom tool are movable toward each other in a press stroke direction forming a die cavity, wherein tempering channels are arranged in at least one die segment to feed a cooling medium, wherein the die segment of the top tool and/or the die segment of the bottom tool is split into at least two parts which are movable in an outward direction transverse to the press stroke direction with a spreader device coupled to the top tool and/or the bottom tool, wherein the spreader device is a spreader ram, wherein the spreader ram is secured in a fixed location on the top tool and/or the bottom tool or the spreader ram is relatively movably located on the top tool and/or the bottom tool, wherein there are at least two die segments slideably located relative to each other on the top tool and/or the at least two die segments are slideably located relative to each other on the bottom tool in an outward direction of motion transverse to the press stroke direction and form a spreader cavity, wherein the die segments are moved toward an outer portion of the press hardening tool by the spreader ram as the spreader ram enters into the spreader cavity.

2. The hot-forming and press hardening tool in accordance with claim 1, wherein the die segments are located on the top tool and/or the bottom tool with retracting devices, and/or that the die segments are coupled among each other with a retracting device, so that the die segments are returned to an original position as the hot-forming and press hardening tool opens.

3. The hot-forming and press hardening tool in accordance with claim 1, wherein the spreader ram can be actuated by an actuator relative to the top tool and/or the bottom tool.

4. The hot-forming and press hardening tool in accordance with claim 1, wherein for purpose of feeding a cooling medium, the tempering channels are present in the top tool and/or the bottom tool with elastic and/or sliding connections and/or a heating segment is arranged in the die segment.

5. The hot-forming and press hardening tool in accordance with claim 1, wherein dead stop devices and/or spacers are arranged in that the die segments are located movably in press stroke direction relative to the top tool and/or to the bottom tool.

6. A method for operating a hot-forming and press hardening tool in accordance with claim 1, wherein during the closing motion and/or at the bottom dead center of the hot-forming tool moving the at least one die segment transverse to the press stroke direction, so that in the die cavity, a section of the die cavity is oriented at plus/minus 20°, preferably plus/minus 10° to the press stroke direction and has a contact surface with a formed sheet metal blank that corresponds to at least 80% of the surface pressure of the essentially horizontally oriented sections of the die cavity.

* * * * *